US009585538B2

(12) United States Patent
Calhoun et al.

(10) Patent No.: US 9,585,538 B2
(45) Date of Patent: Mar. 7, 2017

(54) BOOSTER TANK

(75) Inventors: James S. Calhoun, Corbin, KY (US); Paul Wells, Corbin, KY (US)

(73) Assignee: Jackson WWS, Inc., Barbourville, KY (US)

( * ) Notice: Subject to any disclaimer, the term of this patent is extended or adjusted under 35 U.S.C. 154(b) by 1154 days.

(21) Appl. No.: 12/459,787

(22) Filed: Jul. 8, 2009

(65) Prior Publication Data

US 2010/0012156 A1 Jan. 21, 2010

Related U.S. Application Data

(60) Provisional application No. 61/134,202, filed on Jul. 8, 2008.

(51) Int. Cl.
*A47L 15/42* (2006.01)

(52) U.S. Cl.
CPC ..... *A47L 15/4285* (2013.01)

(58) Field of Classification Search
USPC ..... 134/56 D, 57 D, 58 D, 105, 108
See application file for complete search history.

(56) References Cited

U.S. PATENT DOCUMENTS 3,186,418 A * 6/1965 Stern ..... 134/58 D
4,773,436 A * 9/1988 Cantrell et al. ..... 134/108
5,816,273 A * 10/1998 Milocco et al. ..... 134/108
2007/0181162 A1* 8/2007 Classen et al. ..... 134/25.2
2008/0314414 A1* 12/2008 Hildenbrand ..... 134/25.2

FOREIGN PATENT DOCUMENTS

EP 1082938 A2 * 3/2001

OTHER PUBLICATIONS

Machine Translation of Kulbach, EP 082938 A2 , Mar. 2001.*
Machine Translation of EP 1082938 A2, Kuhlbach, Mar. 2001.*

* cited by examiner

*Primary Examiner* — David Cormier
(74) *Attorney, Agent, or Firm* — Nelson Mullins Riley & Scarborough LLP

(57) ABSTRACT

A dishwashing machine includes a tub having an interior that holds a first liquid and a booster tank that includes a housing and at least one heater disposed within the housing. The booster tank is at least partially disposed within the interior of the tub such that at least a portion of the booster tank is at least partially submerged within the first liquid, whereby the first liquid is heated by the booster tank. A dishwashing machine includes a tub containing a liquid therein and a wash pump assembly that includes a pump housing; an inlet in the pump housing; an outlet in the pump housing; and a pump having a motor that pumps the liquid from the tub through the pump housing via the inlet to a device that sprays the liquid within a dishwasher via the outlet. The liquid is heated by means of a heater which is disposed either in proximity to the inlet, in proximity to the outlet, and/or in the spray device before the liquid is pumped out of the spray device.

8 Claims, 11 Drawing Sheets

BOOSTER TANK

CROSS-REFERENCE TO RELATED APPLICATIONS

This application claims the benefit of U.S. Provisional Application No. 61/134,202, filed Jul. 8, 2008. U.S. Provisional Application No. 61/134,202, filed Jul. 8, 2008 is hereby incorporated by reference in its entirety.

BACKGROUND OF THE INVENTION

1. Field of the Invention

The present disclosure relates generally to devices for increasing a temperature of water from a water source in a dishwashing machine and methods therefore. More particularly, the present disclosure relates to a booster tank for use with a dishwashing machine or warewashing machine.

2. Description of Related Art

Booster tanks provide for an increase in temperature of water supplied to a dishwashing machine for washing wares such as, glasses, utensils, plates, and the like. For example, hot water may be supplied to a booster tank from a building's hot water supply at about 110 degrees Fahrenheit to about 120 degrees Fahrenheit. The booster tank heats the water to a minimum temperature, such as, for example, the National Sanitation Foundation (NSF) standard of about 180 degrees Fahrenheit. Typical booster tanks are mounted by a mounting plate on an outside, angled surface of a dishwasher exposed to the ambient air. Therefore, heat from the booster tank and water therein is radiated to ambient air and lost from the system resulting in an increase in energy and/or water consumption and inefficiency in operation.

Booster tanks may be required to be positioned outside a footprint of the dishwashing machine. The footprint of a dishwasher machine measures the amount of floor space the dishwashing machine requires for placement. Most conveyor type dishwashing machines are limited in space below a tub and a larger booster would have to be mounted outside of a footprint or on top of the machine. Both locations are undesirable. Most conveyors with booster tanks have a large floor mounted booster tank outside of the footprint undesirably taking up square footage of floor space.

In addition, service items of a dishwashing machine are in multiple locations. Thus, assembly and service of these service items require access to multiple locations on the dishwashing machine.

Accordingly, it has been determined by the present disclosure, there is a need for a reduction in energy transfer from the booster tank to the ambient air. There is a further need for improved energy transfer between a heating element of the booster tank with liquid or water within the booster tank. There is still a further need for minimizing heat or energy transfer from the booster tank to ambient as well as capturing that heat loss within the dishwashing machine water. In addition, there is a need for reducing the locations of service items of the dishwashing machine tank.

BRIEF SUMMARY OF THE INVENTION

A booster tank includes a housing and a heating element within the housing. The booster tank is connectable to an interior of a tub of a dishwashing machine to transfer heat from the booster tank to the liquid within the tub.

A booster tank is also provided that includes a housing having a sidewall enclosing a volume for holding a first liquid therein, a heating element in the volume, and a wash tank sump connected to the sidewall of the booster so that the booster transfers heat to a second liquid within wash tank sump.

The above-described and other advantages and features of the present disclosure will be appreciated and understood by those skilled in the art from the following detailed description, drawings, and appended claims.

DETAILED DESCRIPTION OF THE INVENTION

Figure 1:
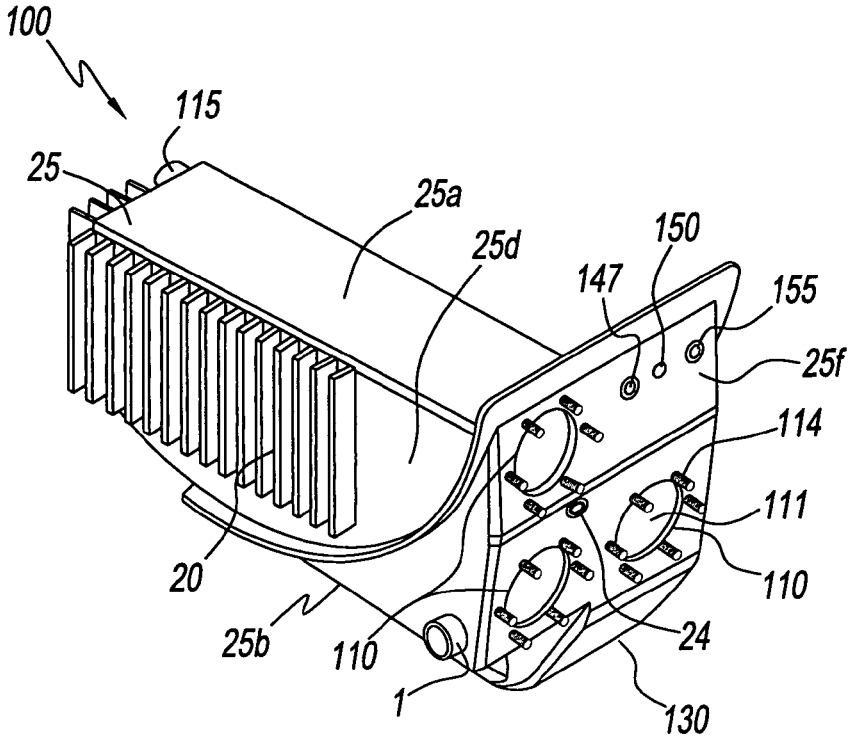
FIG. 1 is a front perspective view of an exemplary embodiment of a booster tank according to the present disclosure.

Referring to the drawings and in particular to FIG. 1, an exemplary embodiment of a booster tank according to the present disclosure is generally referred to by reference numeral 100.

Referring to FIGS. 1 through 6, booster tank 100 has a housing 25. Housing 25 may comprise a top wall 25*a*, a bottom wall 25*b*, a first sidewall 25*c*, a second sidewall 25*d*, a back wall 25*e*, and a front wall 25*f*. Housing 25 may have a fitting 112 that is complimentary to a surface that booster tank 100 is mounted on. Housing 25 may be any shape that allows for flow of liquid therethrough. Liquid is described herein as water, however, the present disclosure contemplates any liquid that cleans wares within a dishwashing machine.

Front wall 25*f* may have one or more openings 110 for the connection of one or more service items. One or more openings 110 of front wall 25*f* may allow installation, service, and/or removal of any or all service items of booster tank 100, such as, for example, heating elements, thermostats, wash tank water level floats, temperature probes, gaskets, valves, and any other service item in one location reducing an amount of required welded fittings and time needed for installation of the service items to booster tank 100. Front wall 25*f* may have one or more projection studs 114, such as for example, four to eight projections studs, for mounting service items such as heaters.

Figure 2:
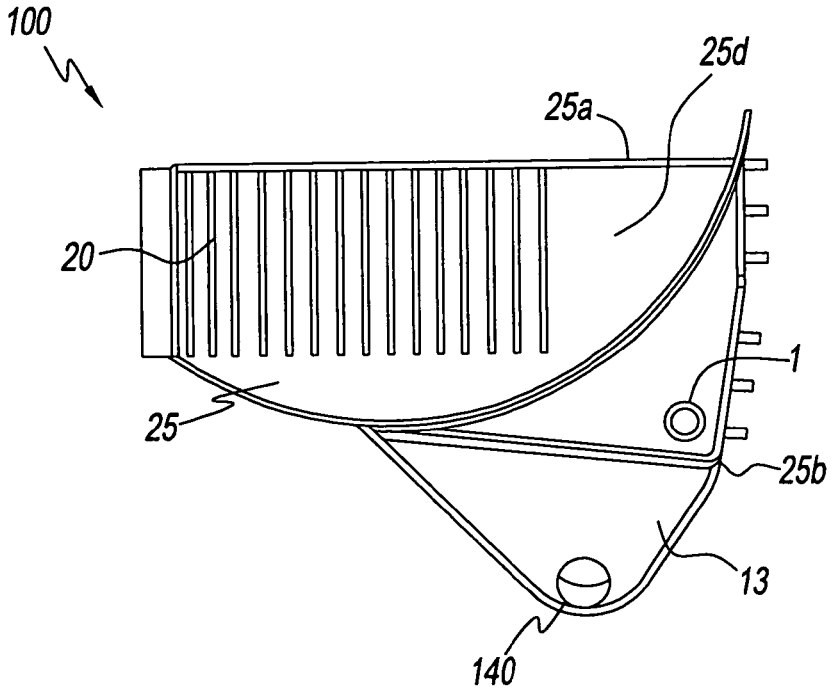
FIG. 2 is a side view of the booster tank of FIG. 1.
Figure 3:
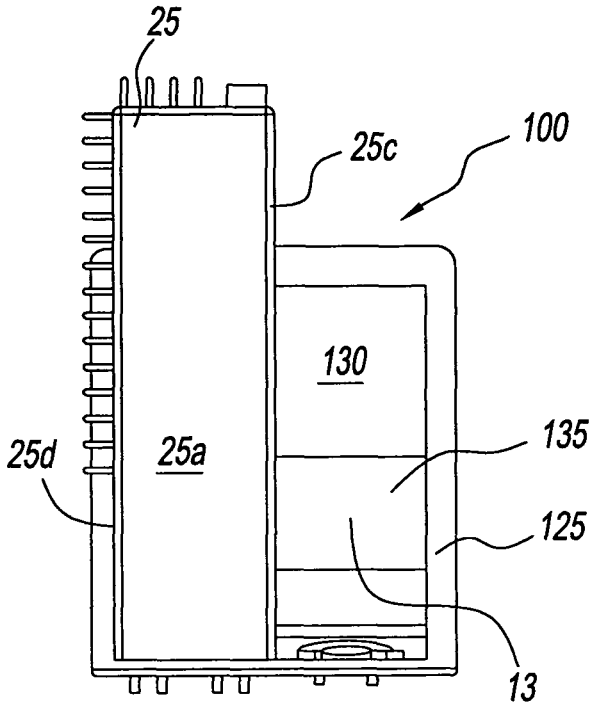
FIG. 3 is a top view of the booster tank of FIG. 1.
Figure 4:
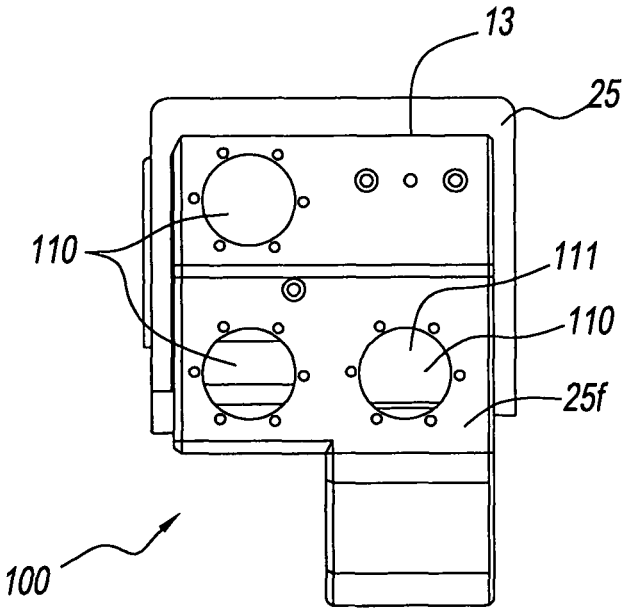
FIG. 4 is a front view of the booster tank of FIG. 1.
Figure 5:
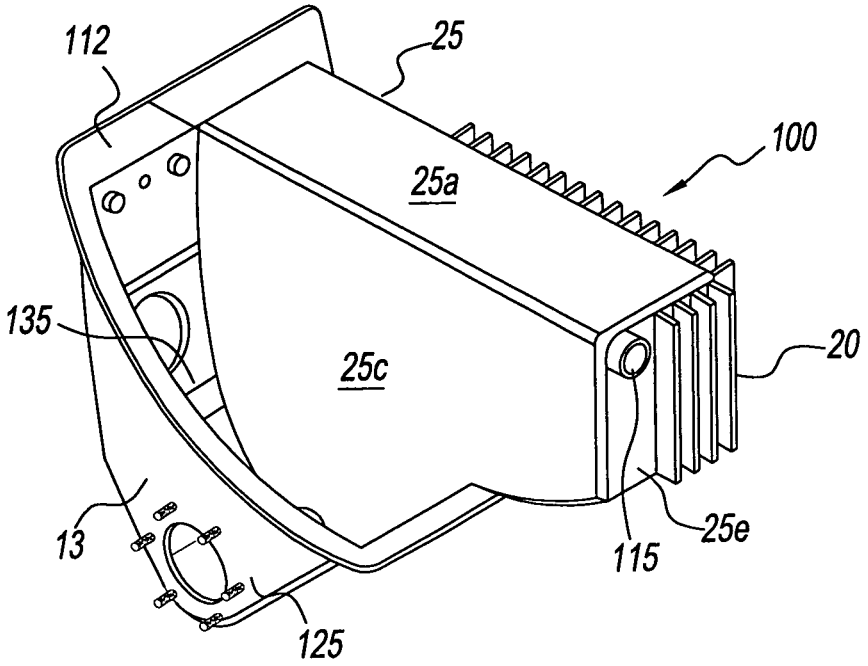
FIG. 5 is rear perspective view of the booster tank of FIG. 1.

Housing 25 may have a plurality of fins 20. Energy or heat generated by heating elements within housing 25 may be transferred to water within housing 25, the walls of housing 25, and plurality of fins 20 through conduction. Plurality of fins 20 and the walls of housing 25 transfer energy from within an interior volume 105 (FIG. 14) outside of housing 25, for example, to a liquid surrounding housing 25. Plurality of fins 20 may be connected to any outer surface of housing 25 where energy transfer or heat transfer is desired, for example, on second sidewall 25*d* and back wall 25*e*, as shown in FIGS. 1 through 3.

Figure 11:
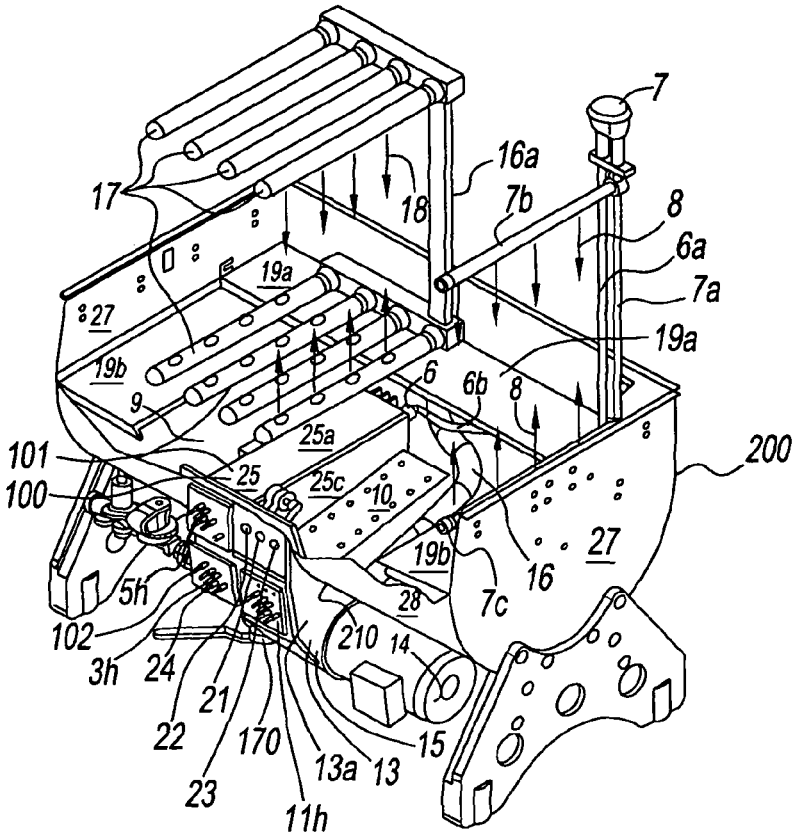
FIG. 11 is a front perspective view of an exemplary embodiment of a dishwashing machine having the booster tank of the present disclosure.
Figure 12:
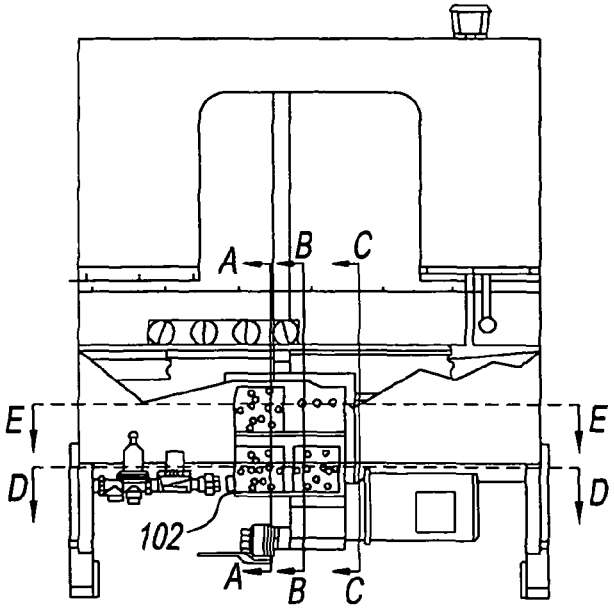
FIG. 12 is a front view of the dishwashing machine having the booster tank of FIG. 11.

Housing 25 has an inlet opening 1. Inlet opening 1 is an opening in housing 25 allowing passage of water therethrough. Inlet opening 1 may be located on a side of housing 25, for example, second sidewall 25*d*, as shown in FIG. 1, or can alternately be located at the front, bottom or rear of exposed surfaces of booster tank 100, such as, for example, on a surface that is exterior to a tub weldment 210 of shown in FIG. 11. Inlet opening 1 may be located on housing 25 within tub weldment 210 by tubing that extends from inlet opening 1 through a separate fitting through tub weldment 210.

Housing 25 has a rinse water outlet fitting 115 allowing passage of water therethrough. Back wall 25*e* may include rinse water outlet fitting 115. However, rinse water outlet fitting 115 may be on any outer surface of housing 25.

Booster tank 100 may be connected to a wash pump sump section 13. Wash pump sump section 13 has first sump wall 125 connected to a second sump wall 130. Second sump wall 130 is connected to first sidewall 25*c* and may extend below bottom wall 25*b* of booster tank 100. First sump wall 125 is connected to front wall 25*f* of booster tank 100. Wash pump sump section 13 has a sump opening 135 between first sidewall 25*c* and first sump wall 125 for flow of liquid therein. First sump wall 125 and second sump wall 130 may be connected to fitting 112. Wash pump sump section 13 may be any shape allows flow of water therein.

Figure 19:
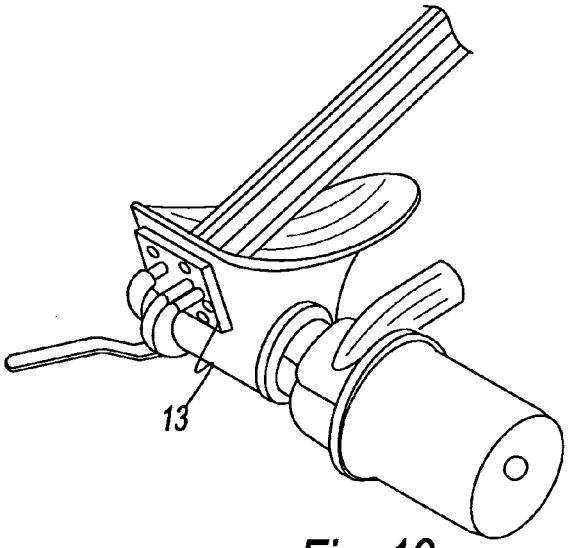
FIG. 19 is a front perspective view of a sump pump separate from the booster tank.

Wash pump sump section 13 and booster tank 100 may be a single casting as shown in FIGS. 1 through 10. Alternatively, wash pump sump section 13 may be separated as a separate casting, as shown in FIG. 19, or wash pump sump section 13 and booster tank 100 may be mounted to either tub end 27 through an appropriate sealed opening and be fully or partially submerged within a wash tank water of a dishwashing machine to achieve the desired heat transfer.

As shown in FIGS. 1 through 6, front wall 25*f* may have holes for one or more services items for wash pump sump section 13, such as, for example, a wash tank thermostat fitting 147, a water level float opening 150, and a temperature probe fitting 155, and the like.

Figure 6:
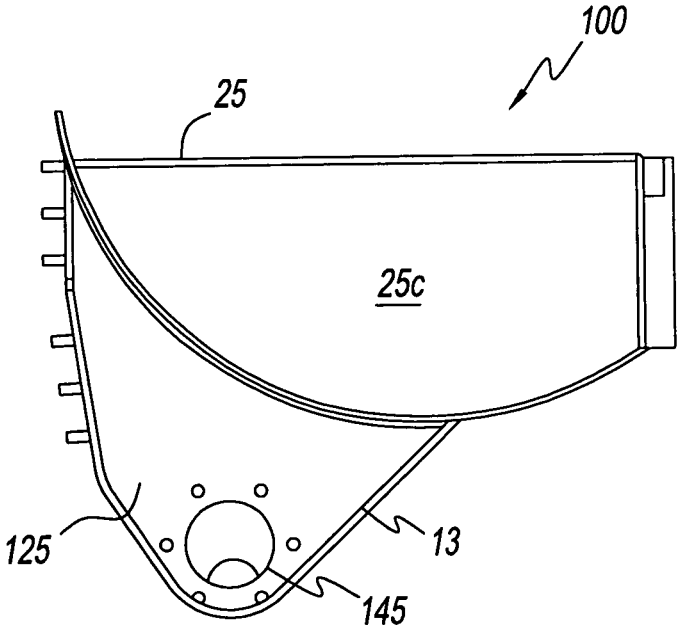
FIG. 6 is a side view of the booster tank of FIG. 1.
Figure 7:
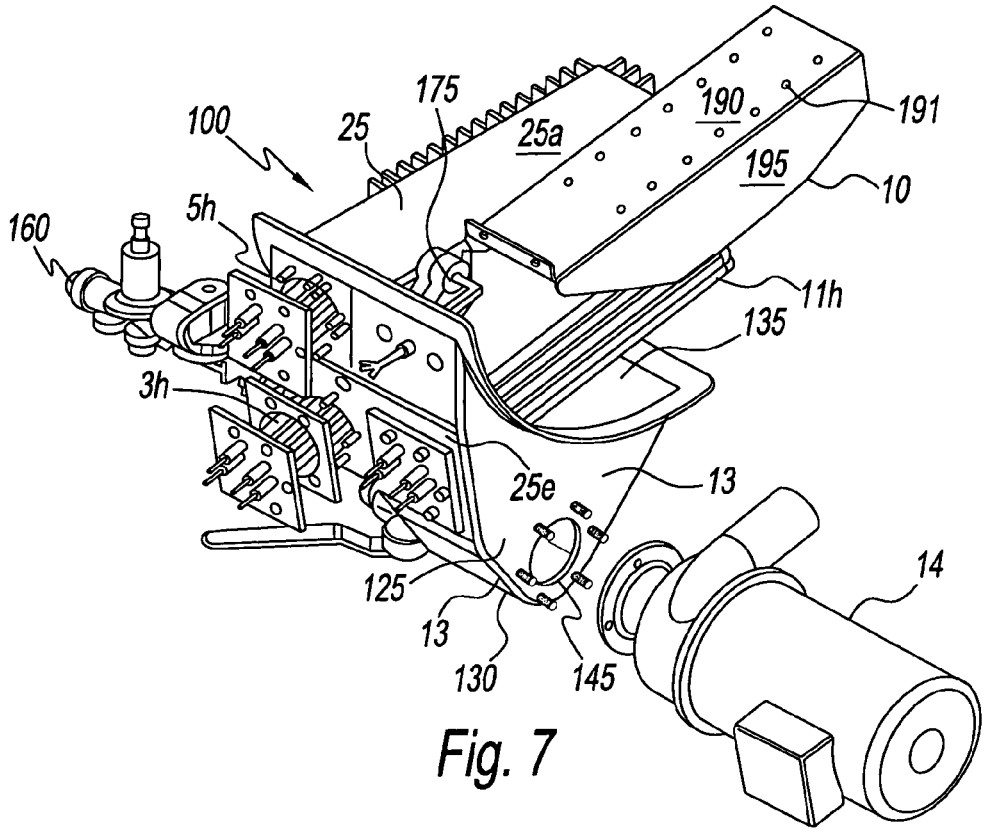
FIG. 7 is a front perspective view of the booster tank of FIG. 1 with heating elements, service items, wash pump, shroud, and plumbing.

As shown in FIGS. 1 through 6, wash pump sump section 13 has a drain connection 140 and a wash pump suction connection 145 each for passage of water therethrough. Drain connection 140 may be through first sidewall 25*c*. Wash pump suction connection 145 may be through first sump wall 125, as shown in FIG. 6.

Figure 14:
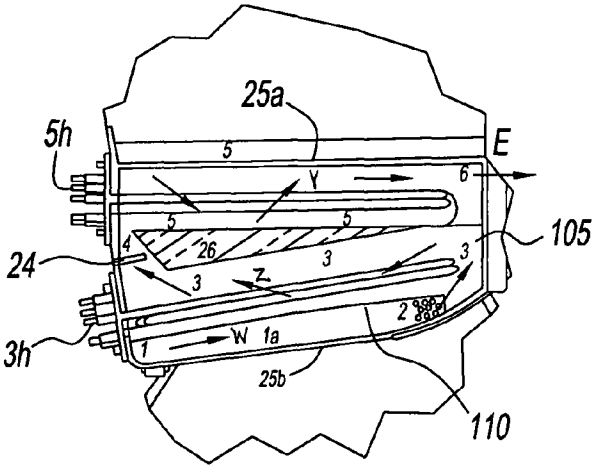
FIG. 14 is a partial enlarged cross-sectional view of FIG. 13 showing the booster tank.
Figure 13:
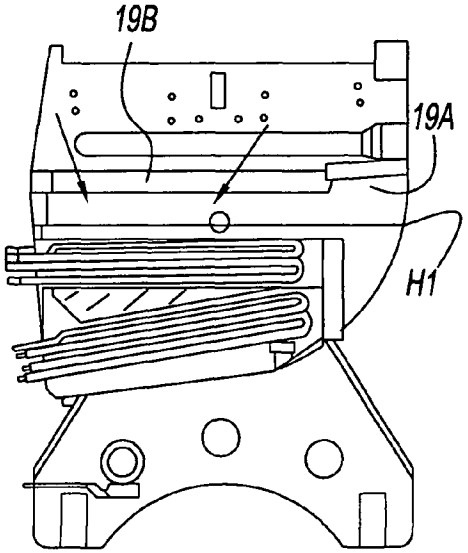
FIG. 13 is cross-sectional view of the dishwashing machine having the booster tank taken along line A-A of FIG. 12.
Figure 16:
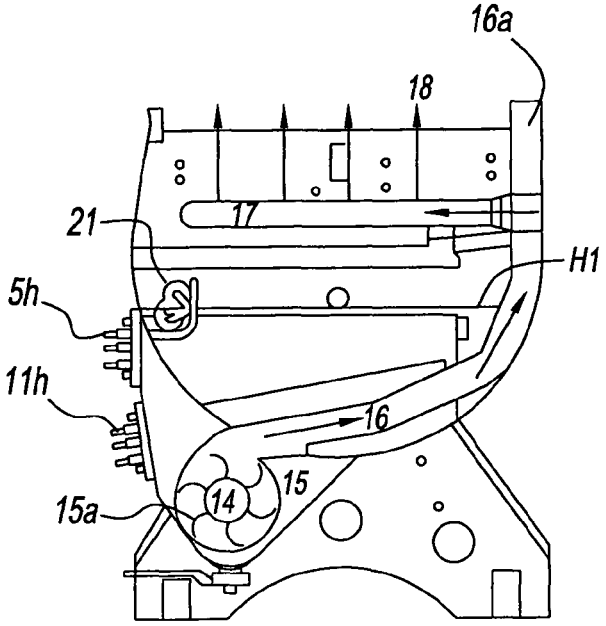
FIG. 16 is cross-sectional view of the dishwashing machine having the booster tank taken along line C-C of FIG. 12.
Figure 17:
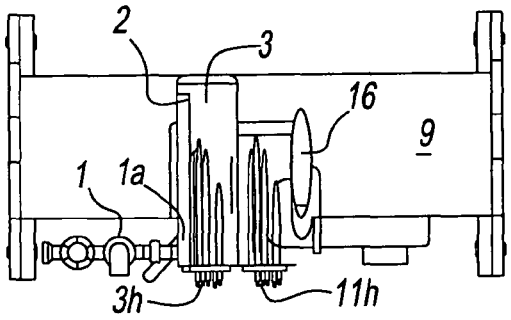
FIG. 17 is cross-sectional view of the dishwashing machine having the booster tank taken along line D-D of FIG. 12.
Figure 18:
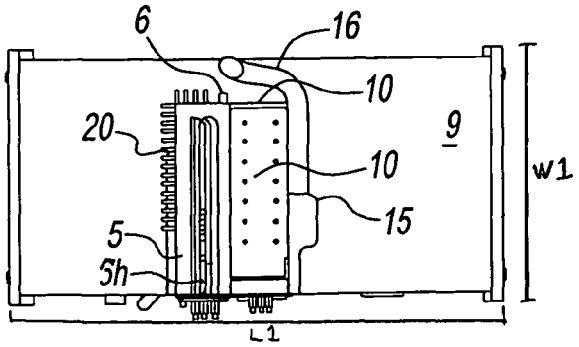
FIG. 18 is cross-sectional view of the dishwashing machine having the booster tank taken along line E-E of FIG. 12.

As shown in FIGS. 7 through 10 and 14, a lower booster heater 3*h* may extend through one or more openings 110 in front wall 25*f* to heat water within booster tank 100. An upper booster heater 5*h* may extend through another of one or more openings 110 in front wall 25*f* to heat liquid within booster tank 100. Lower booster heater 3*h* may extend into lower booster section 3, as shown in FIGS. 13 and 14. Upper booster heater 5*h* may extend into upper booster section 5, as shown in FIGS. 13 and 14. Lower booster heater 3*h* and upper booster heater 5*h* may be removably connected to booster tank 100 to allow for installation and service. Any number or type of heating element that heats water within booster tank 100 may be used.

As shown in FIGS. 7 through 10, inlet opening 1 connects to a water source, such as, for example, through an inlet water supply plumbing 160. Inlet water supply plumbing 160 includes such as, for example, solenoid cutoff valve, union for quick disconnect service or installation, optional pressure regulating valve, y strainer, hammer arrestor, pressure gauge, and any other types of plumbing. Inlet water supply plumbing 160 may be about 0.5 inch to about 0.75 inch. Inlet water supply plumbing 160, for example, connects to a building's hot water supply.

As shown in FIGS. 7 through 10, a wash tank thermostat 165 may fit into wash tank thermostat fitting 147 in front wall 25*f*. Thermostats may be, such as, for example, a standard screw in thermometer or standard bulb and fluid thermostats used with temperature probe 180 that may be one or more thermistors. Wash tank thermostat 165 controls the amount of energy or heat provided by a wash tank heater 11*h*. A water level float 175 may fit within water level float opening 150, shown in FIG. 1, to provide for proper water level to maintain coverage of heaters and provide proper operation of pumps. A temperature probe 180 may fit within temperature probe fitting 155, shown in FIG. 1. Temperature probe 180 senses a temperature of liquid within wash pump sump section 13.

As shown in FIGS. 1 through 6, wash tank heater 11*h* may extend through a wash tank heater opening 111 in front wall 25*f*. Wash tank heater 11*h* may be removably connected to front wall 25*f* to allow for installation and service. Any number or type of heating element that heats water within wash pump sump section 13 may be used, for example, electrical or steam heaters. Studs for connection of wash tank heater 11*h* may surround wash tank heater opening 111.

Figure 8:
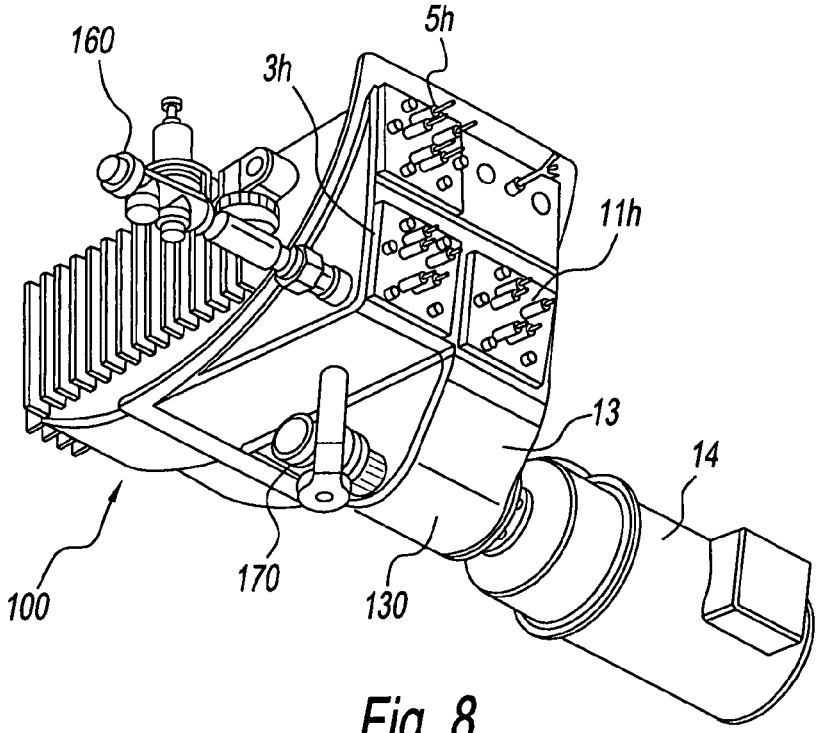
FIG. 8 is a bottom perspective view of the booster tank of FIG. 7.
Figure 9:
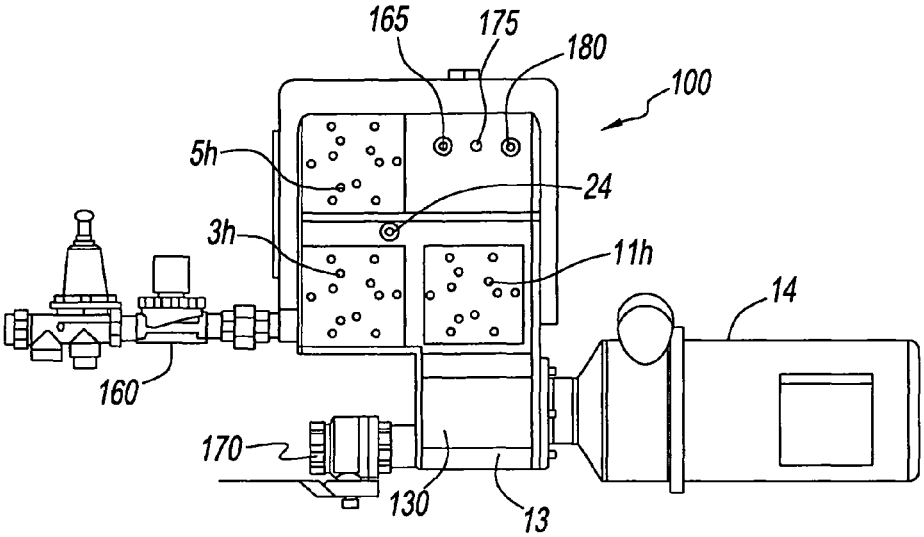
FIG. 9 is a front view of the booster tank of FIG. 7 connected to the wash pump and motor, plumbing, and shroud.
Figure 10:
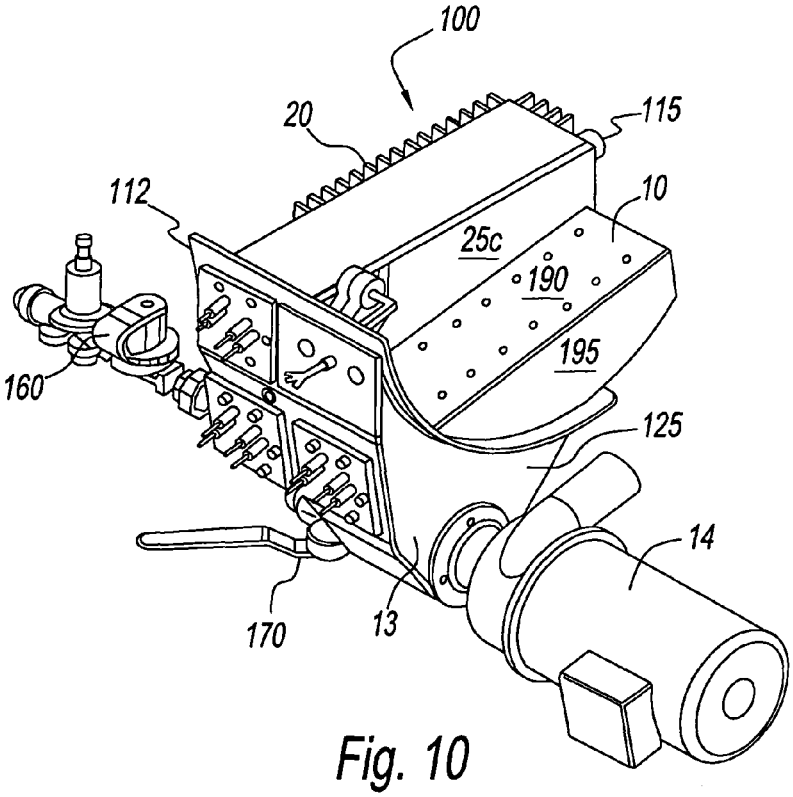
FIG. 10 is a front perspective view of the booster tank of FIG. 9.

Drain connection 140 drains fluid out of wash pump sump section 13, such as, for example through a wash tank drain 170, as shown in FIGS. 8 and 9. Wash tank drain 170 may be a ball type valve or gate valve both of which may be operated by handle or motorized. Wash pump suction connection 145 is connectable to a wash pump 14, as shown in FIG. 7 through 10. Pump 14 may be, for example, a centrifugal pump that is 0.5 to 3.0 horsepower. Wash pump connection may have one or more studs 114, shown in FIG. 1, to connect pump 14.

Sump opening 135 of wash pump sump section 13 may be at least partially covered by a shroud 10, as shown in FIGS. 7 through 10. Shroud 10 may have a first shroud sidewall 190 and a second shroud sidewall 195. First shroud sidewall 190 connects to front wall 25*f* so that first shroud sidewall 190 is adjacent first sidewall 25*c* and second shroud sidewall 195 is adjacent first sump wall 125. Shroud 10 and first sidewall 25*c* of booster tank 100, direct flow of liquid entering wash pump sump section 13. Shroud 10, preferably, is substantially the same length as wash tank heater 11*h*. Shroud 10 may have one or more holes 191 in first sidewall 190. One or more holes 191 prevent trapping air underneath shroud 10. Shroud 10 may have holes and/or mesh type strainer which directs washtank water from the wash tank across wash tank heater 11*h* prior to it entering wash pump 14.

Booster tank 100 or booster tank 100 and sump section 13 may include wiring for electrical connections and installed plumbing prior to connection to a dishwashing machine. For example, upper heating element 5*h*, lower heating element 3*h*, wash tank heater 11*h*, rinse tank thermostat, wash tank thermostat, wash tank water level float, wash tank temperature may be wired for electrical connection to a power source, and wash tank drain 170, inlet water supply plumbing 160 may be installed prior to connection of booster tank 100 to a dishwashing machine.

The operation of booster tank 100 used with one type of dishwashing machine 200 is described with simultaneous reference to FIGS. 11 through 18. However, booster tank 100 may be used with any type of dishwashing machine, such as, for example, conveyer dishwashing machines, door-type dishwashing machines, glasswasher dishwashing machines, undercounter dishwashing machines, or flight type dishwashing machines. The dishwashing machine may use gas, electric, and/or steam as a heating source for both rinse booster tank and wash tank.

Dishwashing machine 200 has a tub weldment 210. Tub weldment 210 has an interior volume that holds wash water 9. Tub weldment 210 is connected to booster tank 100, sump pump section 13, internal angled runoffs 19*a*, 19*b*, wash arms 17, and upper rinse arm 7*b* and lower rinse arm 7*c*. Dishwashing machine 200 may have a control system, such as, for example, a microprocessor with memory, to control various systems, such as, for example, temperature or water flow.

As shown in FIGS. 11 through 18, booster tank 100 is connected to tub weldment 210 so that at least a portion of the booster tank is within the interior volume of tub weldment. An interior booster portion 101 of booster tank 100 is within the interior volume of tub weldment 210 that holds wash water 9 and an exterior booster portion 102 of booster tank 100 is outside of the interior volume of tub weldment 210. Top wall 25*a*, a portion of first sidewall 25*c*, a portion of second sidewall 25*d* having plurality of fins 20, and a portion of back wall 25*e* having plurality of fins 20 may be within the interior volume of tub weldment 210. A portion of first sidewall 25*c*, a portion of second sidewall 25*d* without plurality of fins 20, a portion of back wall 25*e* without plurality of fins 20, and bottom wall 25*b* may be outside of the interior volume of tub weldment 210. Advantageously, booster tank 100 may have inlet opening 1 so that all plumbing connections to water sources outside of the dishwashing machine system, such as, for example, a building's hot water supply, are underneath tub weldment 210 minimizing or eliminating added square footage of floor space to a footprint of a dishwashing machine.

Sump pump section 13 is connected to tub weldment 210 so that an exterior sump portion 13*a* of sump pump section 13 is outside of the interior volume of tub weldment 210 and sump opening 135 is within the interior volume of tub weldment 210. Advantageously, exterior sump portion 13*a* may have drain connection 140 and wash pump suction connection 145 so that all plumbing connections to water sources outside of the dishwashing machine system are underneath tub weldment 210 freeing the top of dishwashing machine for storage, such as, for example, storage of clean racks, and minimizing or eliminating added square footage of floor space to a footprint of a dishwashing machine. Racks that may be stored include, such as, for example, any standard NSF rack, and the racks may be, for example, 20 inches in height by 20 inches in width by 4 inches in depth.

Fitting 112 is shaped to connect and seal booster tank 100 and sump pump section 13 with tub weldment 210, such as, for example welding, gasket and bolts, and the like. Fitting 112 may abut the interior volume of tub weldment 210 so that the connection is substantially impervious to liquid. Booster tank 100 and sump pump section 13 may be removable from tub weldment 210 for service and replacement, such as, for example, booster tank 100 may be bolted to tub 200 and bolts may be removed from outside or inside tub 200, so that booster tank 100 is easily removable.

Upper rinse arm 7*b* and lower rinse arm 7*c* are tubes having one or more apertures to dispense liquid or rinse water from booster tank 100. Upper rinse arm 7*b* and lower rinse arm 7*c* receive liquid via a rinse manifold 7*a* from booster tank 100.

Figure 21A:
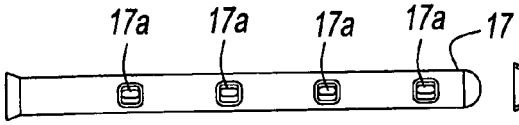
FIGS. 21*a* through 21*c* are a top view, a side cross-sectional view taken along line B of FIG. 21*a*, and a side cross-sectional view taken along line A of FIG. 21*a*, respectively, of a wash arm.
Figure 21B:
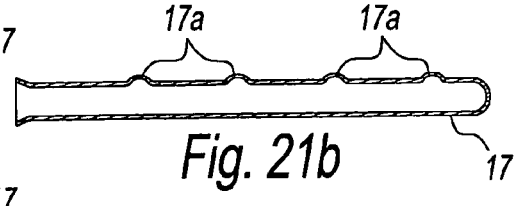
Figure 21C:
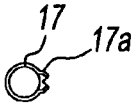

Wash arms 17 are tubes having one or more apertures to dispense liquid or wash water 9 from sump pump section 13. Wash arms 17 receive liquid from sump pump section 13 via a wash manifold 16*a* and discharge tubing 16. As shown in FIGS. 21*a* through 21*c*, wash arms 17 may have a plurality of apertures 17*a*. Plurality of apertures 17*a* may be convex embossments to allow for reduction of trapped food particles.

Figure 20:
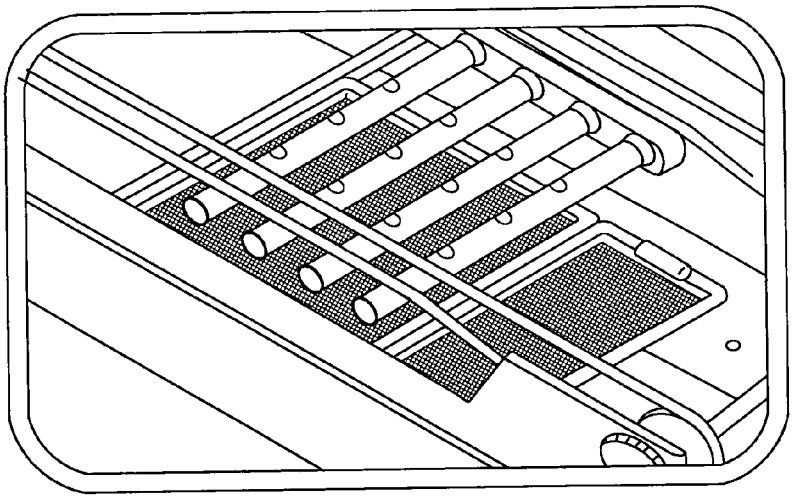
FIG. 20 is front perspective view of a dishwashing machine having strainer trays.

Sprayed wash water 18 as well as sprayed rinse water 8 are both returned to the battery of wash water 9 via internal angled runoffs 19*a*, 19*b* that direct water. Water then falls through the scrap trays (FIG. 20) to the battery of water.

Referring to FIGS. 13 and 14, booster tank 100 may have an internal separation plate 26 that separates interior volume 105 of housing 25 into a lower booster section 3, a transfer channel 4, and an upper booster section 5 to establish a flow path for liquid.

Referring to FIG. 14, arrows W, X, Y, and Z depict the approximate rinse water flow direction within booster tank 100. Rinse water enters booster tank 25, as shown by arrow W, via incoming water plumbing and through an appropriately sized fitting or inlet opening 1 to provide the proper flow rate and pressure required per a dishwashing machine's rated capacity.

Rinse water may flow through inlet opening 1 to an inlet channel 1*a*. Inlet channel 1*a* may include a separation wall 110 that extends from one of sidewalls 25*c* to another sidewall 25*d* along a length of lower heating element 3*h* within housing 25 of booster tank 100. Inlet channel 1*a* has inlet opening 1 on a first side and plurality of dispersion holes 2 on an opposite, second side of inlet channel 1*a*. Inlet channel 1*a* directs water toward a plurality of dispersion holes 2 at an end opposite of inlet opening 1 of inlet channel 1*a*. This ensures that the rinse water must pass along the entire length of lower heating element 3*h* in a lower booster section 3 and does not bypass lower heating element 3*h*. Inlet channel 1*a* allows for preheating of the rinse water before entering lower booster section 3.

The inlet channel 1*a* may be of any cross sectional shape provided that the cross sectional area of the channel, preferably, is equal to or exceeds the area of the inlet plumbing and/or opening 1, and, more preferably, is equal to or exceeds the area of the inlet plumbing and/or opening 1 along the entire length of the channel. The plurality of dispersion holes 2 combined area, preferably, is equal to or exceeds the area of the same plumbing and/or inlet opening 1.

After exiting the dispersion holes 2, the rinse water enters lower booster chamber 3. The rinse water is heated by lower heating element 3*h* in lower booster chamber 3. Energy transfer is maximized by ensuring that the flow of the rinse water is longitudinal to lower heating element 3*h*, as shown by arrows Z, and by minimizing a distance of the lower heating element to the water by minimizing a distance from bottom wall 25*b*, first sidewall 25*c*, second sidewall 25*d*, separation wall 110, and internal separation plate 26.

Rinse water is directed to transfer channel 4 from lower booster chamber 3 and into upper booster chamber 5 by pressure provided by incoming water plumbing. Rinse water enters upper booster chamber 5 from transfer channel 4 and is heated by an upper heating element 5*h*. Energy transfer is maximized between upper heating element 5*h* and the rinse water by ensuring the flow of the rinse water, as shown by arrows Y, is longitudinal to the upper heating element and by minimizing a distance of the upper heating element from top wall 25*a*, first sidewall 25*c*, second sidewall 25*d*, and internal separation plate 26.

These booster chambers, for example, lower booster section 3, transfer channel 4, and an upper booster section 5, may be arranged vertically (upper & lower), horizontally (left & right), and/or diagonally. It has been found by the present disclosure that, the number and arrangements of chambers and consequently heating elements are arranged so that the flow of the rinse water is not allowed to bypass any heating element and a temperature of the rinse water is raised within each chamber. Heating element sizing (rated kilowatt (kW)) may vary as long as the rinse water at rinse nozzles 8 (FIG. 11) has a predetermined temperature, such as, for example, of about 180 degrees Fahrenheit that exceeds NSF and/or Local health codes for the specified unit.

The booster tank 100 temperature may be maintained by thermostat 24 shown at the transfer channel 4. It is preferred that thermostat 24 be located no further within the flow path of the rinse water than at the end of first booster chamber 3 to ensure that relatively cold rinse water entering booster tank 100 through inlet opening 1 is detected as soon as possible and provides for rapid response of all heating elements. Thermostat 24, preferably, is located as close to a point at which the rinse water enters lower booster chamber 3 as practical.

The rinse water exits booster tank 100 at a booster tank exit 6, as shown by arrow E in FIG. 14. The rinse water may flow to a rinse header 6*a* from booster tank exit 6 through tubing 6*b*, shown in FIG. 11, for example, through rinse water outlet fitting 115. Rinse header 6*a* may exit tub weldment 210 and proceed outside of tub 200 or travel within tub 200 (below and/or above the wash tank water level).

The rinse water flows from rinse header 6*a* to an anti-siphoning device 7. Anti-siphoning device 7 may be a vacuum breaker or air gap to prevent potential siphoning of dirty water from entering potable water supply lines if a vacuum develops to the potable water supply, such as, for example, an anti-siphoning device of American Society of Sanitary Engineers (ASSE) 1001 the contents which are incorporated by reference herein. Anti-siphoning device may be required by NSF and/or local health code regulations. The rinse water may then be directed to the upper rinse arm 7*b* and lower rinse arm 7*c* via the rinse manifold 7*a*. Rinse water spray 8 is directed over the ware and falls toward a battery of wash water 9 via internal angled runoffs 19*a*, 19*b* within tub weldment 210.

While the rinse water flows through lower booster chamber 3, shown by arrows Z, transfer channel 4, as shown by arrow X, and upper booster chamber 5, as shown by arrows Y, energy transfer occurs from heated rinse water heated in booster tank 100 via conduction through the booster tank walls, for example through top wall 25*a*, first sidewall 25*c*, second sidewall 25*d*, and plurality of fins 20 to battery of wash water 9 within tub weldment 210.

Booster tank 100 may be a cast design. It has been determined by the present disclosure that thicknesses of top wall 25*a*, bottom wall 25*b*, first sidewall 25*c*, second sidewall 25*d* should be minimized to allow for the greatest energy transfer rate to wash water 9 possible without jeopardizing the structural integrity of the tank per the operating temperatures and pressures required. The thickness may be, such as, for example, from about 0.05 inches to about 0.25 inches. A number and sizing of plurality of fins 20 should be maximized and a distance separating fins should be minimized to provide the greatest possible energy transfer area.

It has been determined by the present disclosure, that wash water 9 is heated by booster tank 100 within tub weldment 210 through the walls of booster tank 100 and plurality of fins 20. Advantageously, an increase in energy through energy transfer from booster tank 100 to wash water 9 within tub weldment allows for more heat units or energy to be imparted to ware via a wash spray 18 through wash arms 17 that dispenses wash tank water from wash tank 9 to wares in a wash section of dishwashing machine 200.

Wash tanks typically require heating elements within tub weldment 210 rated in the 10 kW to 20 kW range. Typical booster tanks may require heating elements for a combined total of as much as 45 kW depending on machine specifications. For example, a booster tank having a requirement of 200 gallons per hour (GPH) of water that raises an incoming temperature of 110 degrees Fahrenheit to a final rinse temperature of 180 degrees Fahrenheit will require an energy consumption of 34.2 kW/Hr. This is given by the equation: $Q=mcp\Delta T$ where: Q is the energy consumption, m is the mass flow rate, cp is the specific heat capacity of water and $\Delta T$ is the temperature rise required.

It has been determined by the present disclosure that if an amount of energy or heat units required to sanitize the ware to a predetermined level is achieved in wash water 9 and wash spray 18 by "stealing" or receiving via energy transfer, energy from booster tank 100 that is submerged in tub weldment 210, then rinse water consumption of the final rinse spray, as shown by arrows 8, is reduced. The rinse water consumption may be reduced to a volume just high enough to remove detergent residue from the ware.

For example, a unit such as that shown in FIGS. 11 through 18, a value as low as 60 GPH of rinse water, as shown by arrows 8, may suffice for the same temperature rise given above (110 degrees Fahrenheit to a final rinse temperature of 180 degrees Fahrenheit) having an energy consumption in booster tank 100 of approximately 10.3 kilowatts per hour (kW/Hr). For example, energy transfer from booster tank 100 to wash water 9 may raise a temperature of wash water, such as, for example, by about 1 degree Fahrenheit to about 2 degrees Fahrenheit. Advantageously, energy may be reduced, greater number of wares may be washed, water pressure may be decreased, temperature demand may be decreased to increase amount of wares washed, energy consumption may be reduced, water usage may be reduced, or any combination thereof.

Figure 15:
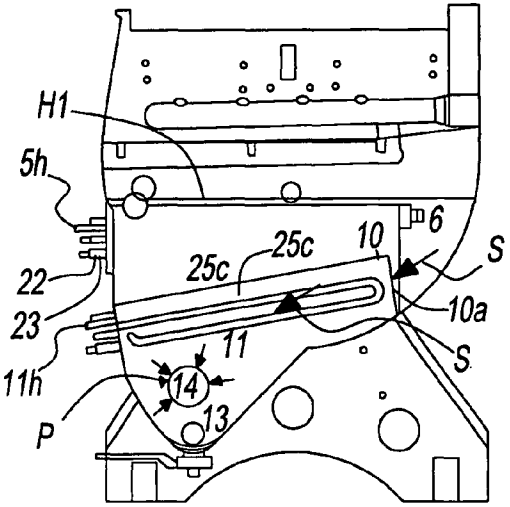
FIG. 15 is cross-sectional view of the dishwashing machine having the booster tank taken along line B-B of FIG. 12.

As shown in FIGS. 11 and 13 through 16, and in particular FIG. 15, wash pump 14 generates suction to draw wash water 9 within tub weldment 210 to flow between wash heater shroud 10 and wash tank sump section 13 into contact with wash tank heater 11*h*, as shown by arrows S. Wash tank heater 11*h* is mounted in such a way as to utilize first sidewall 25*c* of booster tank 100 to direct flow in thermal communication and in close proximity to the wash tank heater as well as aid energy transfer to wash water 9 prior to water entering the wash tank sump 13. The wash heater shroud 10 also directs the water for maximum energy transfer. Advantageously, wash water 9 having energy added by wash tank heater 11*h* may be immediately directed to wash pump 14 and not allowed to disperse to the battery of wash water 9 within tub weldment 210.

Wash water 9 may be directed to tank heater 11*h* via strainer holes 10*a* at or near where liquid enters shroud 10. Strainer holes 10*a* combined area is greater than a cross-sectional area of a pump suction to provide proper volumetric flow rates through the wash pump. It has been found by the present disclosure that wash tank water is directed longitudinally along wash tank heater 11*h*, as shown by arrows S, to maximize energy transfer. A distance from wash tank heater 11*h* and shroud 10 are minimized to maximize energy transfer between liquid and wash tank heater 11*h*.

It has also been found by the present disclosure that by first sidewall 25*c* of booster tank 100 acting as a side of shroud 10, first sidewall 25*c* transfers energy from booster tank 100 to wash water 9. Energy transfer occurs from rinse water heated by heating elements in booster tank 100 via conduction through first sidewall 25*c* to wash water 9. Wash water 9 is directed throughout the area under shroud 11 to sump pump section 13 to wash pump 14, as shown by arrows P in FIG. 15.

Advantageously, water now enters wash pump 14 at a higher temperature than an average overall temperature of wash water 9. Wash water 9 from sump pump section 13 fills an area within a pump casing 15 by suction from a pump impeller 15*a* that imparts mechanical energy to the wash water to discharge the wash water through discharge tubing 16 to a wash manifold 16*a*. Wash water 9 is directed to one or more wash tubes 17 that spray wash water 9, as shown by arrows 18, onto the ware.

Wash water 9 is sprayed at a higher temperature than the average wash tank temperature holding wash water 9, for example, 1-2 degrees Fahrenheit higher than conventional dishwashers. This effect can also be achieved by placing a heating element within a suction tube and/or within a discharge tube of the wash pump. This could take the form of heating elements within with the wash manifolds as well as smaller elements within each individual arm. Additionally, pump discharge tube 16 may be routed to enter a chamber area, for example, lower booster chamber 3 and/or upper booster chamber 5, of the rinse booster tank 25 and gain energy transfer through the wall of the tubing from the relatively hot rinse water. All potential flow paths must ensure the separation of the fresh rinse tank water from the "dirty" wash tank water.

The temperature of wash water 9 can vary greatly for the same energy input due to the shape, size and material makeup of the ware placed in the wash chamber. Hot pans can impart energy to wash water 9 whereas room temperature bowls with residue water in them can lower the temperature. Large ware and plastic trays can absorb greater amounts of energy from wash water 9 being sprayed over them than small plates and glasses. Wash pumps can circulate wash water 9 at rates exceeding 250 gallons per minute (gpm). This suspended water of wash spray 18 can loose energy rapidly in open systems. This is especially true when considering conveyor type ware washers which have curtains as the only means of separating the hot wash chamber from the ambient room temperature air. Advantageously, it has been determined by the present disclosure that booster tank 100 provides for predetermined temperature requirements while radiating heat to wash water 9 during both normal wash cycles as well as idle times by energy transfer to wash tank water in tub weldment and wash tank water being directed by the booster tank housing to at least partially compensate for loss of energy of wash tank water.

Figure 22:
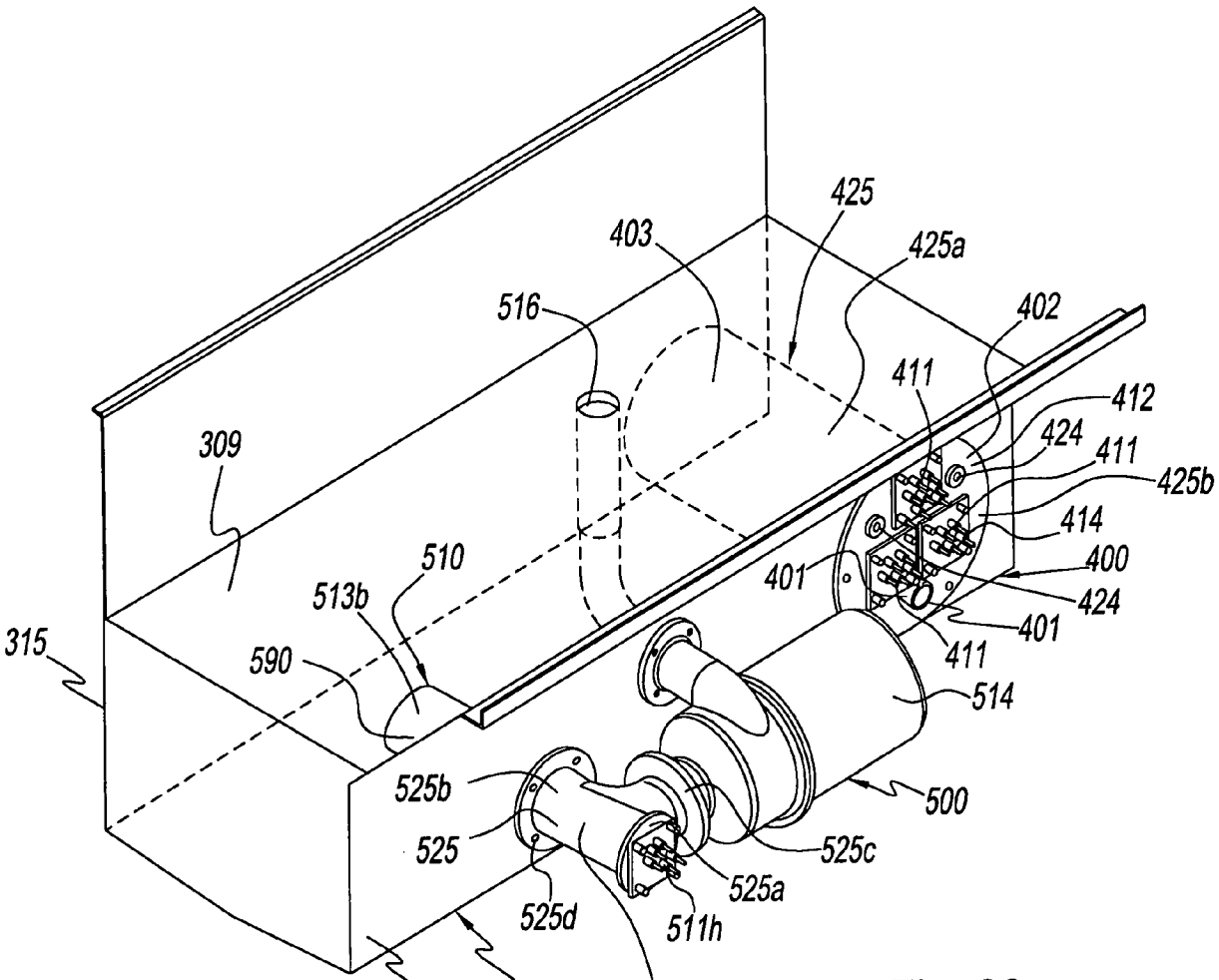
FIG. 22 is a side perspective view of an exemplary embodiment of a partial dishwashing machine having a booster tank and a wash pump section of the present disclosure.
Figure 23:
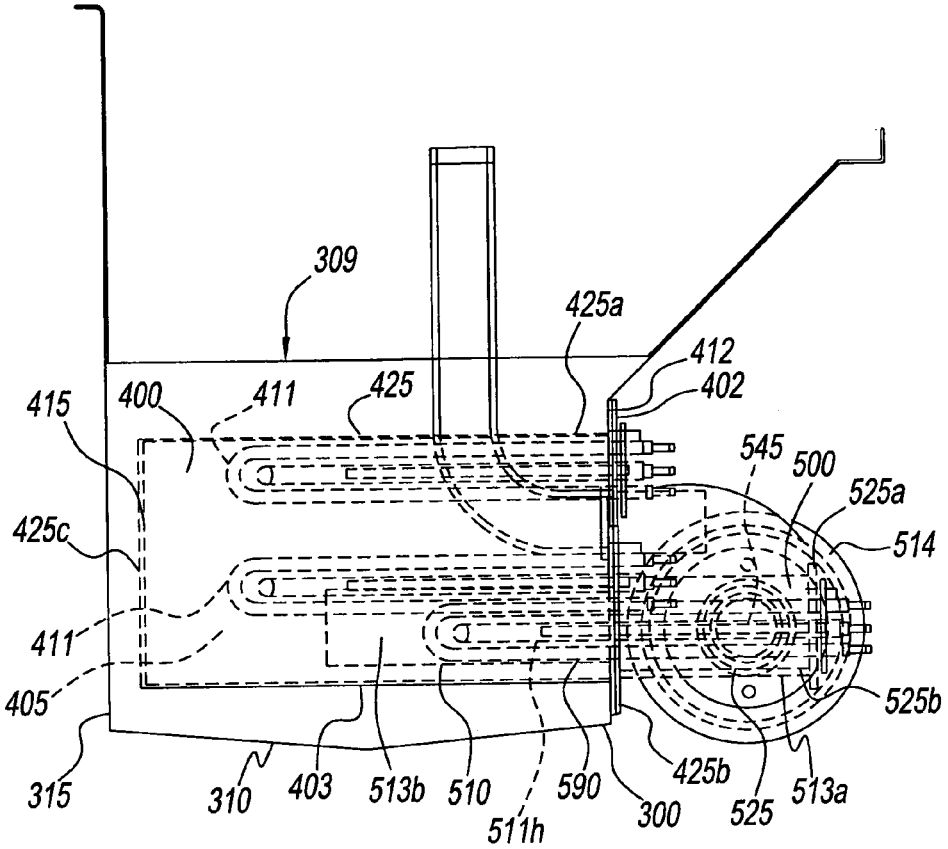
FIG. 23 is a cross-section of the partial dishwashing machine showing a cross-section of the booster tank and a cross-section of the wash pump section of FIG. 22.
Figure 24:
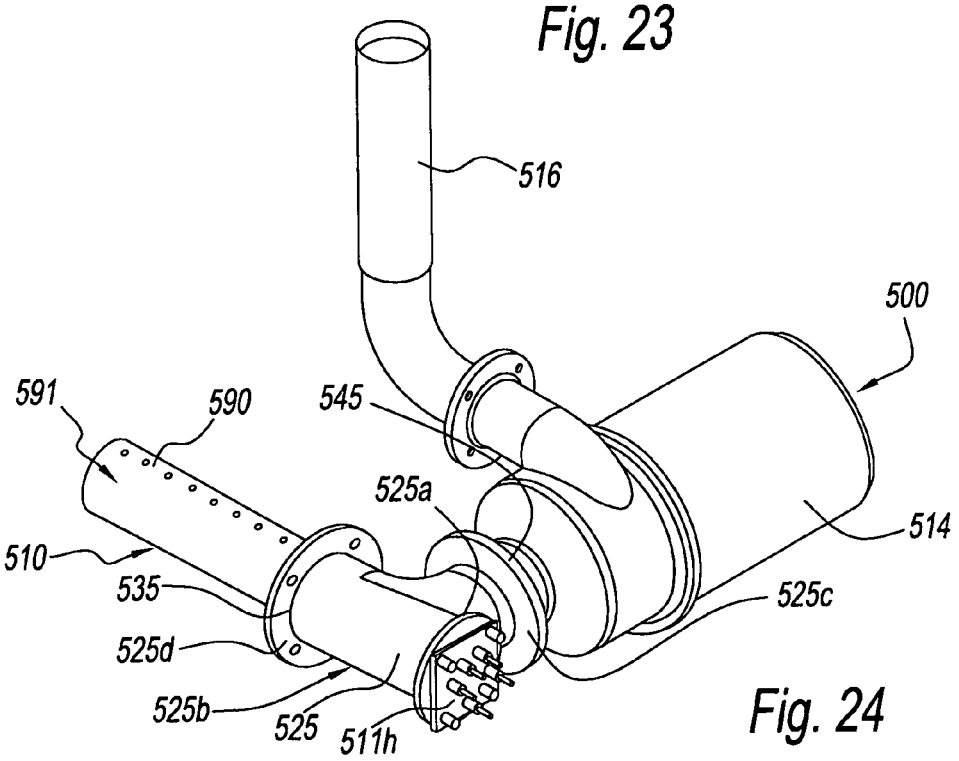
FIG. 24 is the wash pump section of FIG. 22.

Referring now to FIGS. 22 through 24, an exemplary embodiment of a partial dishwashing machine 300 having a booster tank 400 and a wash pump sump section 500 of the present disclosure is shown. Booster tank 400 and wash pump sump section 500 are shown with dishwashing machine 300, however, booster tank 400 and/or wash pump sump section 500 may be used with any dishwashing machine.

Similar to booster tank 100, booster tank 400 has a housing 425 that may be any shape that allows for flow of liquid therethrough, for example, housing 425 is cylindrical having a sidewall 425*a*, a front wall 425*b* and a rear wall 425*c* enclosing an interior volume 405. Housing 425 has a fitting 412 that is complimentary to a surface that booster tank 400 is mounted on.

Generally, booster tanks in dishwashing machines are outside of a tub that holds wash water because wash water may include chemicals that damage the booster tank and cause corrosion or deterioration of the booster tank. However, booster tank 400 is connected to tub weldment 310 so that at least a interior portion 403 of booster tank 400 is within an interior volume of a tub weldment 310 of dishwashing machine 300 that holds wash water 309 and an exterior booster portion 402 of booster tank 400 is outside of the interior volume of tub weldment 310. Exterior booster portion 402 includes front wall 425*b*, however, a portion of sidewall 425*a* or rear wall 425*c* may be included in exterior booster portion 402. For example, rear wall 425*c* and/or a portion of sidewall 425*a* may be exterior to tub weldment 310 such as through a back wall 315 of tub weldment. Interior booster portion 403 includes rear wall 425*c* and sidewall 425*a*. Fitting 412 may abut tub weldment 310 so that the connection is substantially impervious to liquid. Booster tank 400 may be removable from tub weldment 410 for service and replacement, such as, for example, booster tank 400 may be bolted to tub 300 and bolts may be removed from outside or inside tub 300, so that booster tank 400 is easily removable through an opening in a front wall of tub weldment 310.

Front wall 425*b* may have one or more openings (not shown) for the connection of one or more service items. One or more openings of front wall 425*b* may allow installation, service, and/or removal of any or all service items of booster tank 400, such as, for example, heating elements, thermostats, wash tank water level floats, temperature probes, gaskets, valves, and any other service items. The one or more openings of front wall 425*b* may also allow the service items of booster tank 400 to be in one location reducing an amount of required welded fittings and time needed for installation of the service items to booster tank 400. Front wall 425*b* may have one or more projection studs 414, such as for example, four to eight projections studs, for mounting service items such as heaters.

Housing 425 has an inlet opening 401. Inlet opening 401 is an opening in housing 425 allowing passage of water therethrough. Inlet opening 401 may be located on front wall 425*b* or can alternately be located at the side or rear of exposed surfaces of booster tank 400, such as, for example, on a surface that is exterior to a tub weldment 310. Inlet opening 401 may be located on housing 425 within tub weldment 310 by tubing that extends from inlet opening 401 through a separate fitting through tub weldment 310. Inlet opening 401 connects to a water source, for example, a hot water supply of a building. Advantageously, booster tank 400 may have inlet opening 401 so that all plumbing connections to water sources outside of the dishwashing machine system, such as, for example, a building's hot water supply, are below tub weldment 410 minimizing or eliminating added square footage of floor space to a footprint of a dishwashing machine.

Housing 425 has a rinse water outlet fitting 415 allowing passage of water therethrough. Rear wall 425*c* may include rinse water outlet fitting 415 to allow passage of water out of booster tank 400 to a rinse arm. Rinse water outlet fitting 415 on rear wall 425*c* may connect to a connector, such as tubing that connects to rinse arms, that extends through a rear wall of tub weldment and is welded thereto or tubing that extends within tub weldment 310. However, the rinse water outlet fitting 415 may be on any outer surface of housing 425.

Booster tank 400 has one or more heaters 411 that extend within the one or more openings in front wall 425*b*. Heaters 411 extend into interior volume 405 to heat water within interior volume 405. Heaters 411 may be removably connected to housing 425, for example, through the one or more openings in front wall 425*b*, to allow for installation and service. Any number of heaters that heat water within interior volume 405 of booster tank 400 may be used. Other sources of heat generation may be utilized as well. Openings for electrical heating elements may be replaced with inlet and outlets for a stainless steel steam coil which separates pressurized steam and/or steam condensate from the rinse water held within the booster tank. It is only essential that the steam provides adequate thermal energy (BTUs) that is equivalent to the thermal energy provided by the electric heating elements to achieve identical results. Other sources of heat can be utilized as well as long as they are adequately separated from the pure rinse water by an adequate leak proof barrier, for example, tube, coil baffle, or smaller tank within the booster tank. Other possible sources of heat may be gas heated fluids, solar heated fluids, various chemical reactions (Lithium Bromide, LiBr, in a separate cycle, heat generated by introduction of an electric charge to a substance, etc.).

Booster tank 400 has a thermostat 424. Thermostat 424 is connected to front wall 425*b* and extends into interior volume 405. Thermostat 424 may be, such as, for example, a standard screw in thermometer or standard bulb and fluid thermostats used with a temperature probe that may be one or more thermistors. Thermostat 424 controls the amount of energy or heat provided by heaters 411. Dishwashing machine 300 may have a control system, such as, for example, a microprocessor with memory, to control various systems, such as, for example, temperature or water flow.

In use, rinse water flows through inlet opening 401 into interior volume 405. Interior volume 405 may include separation walls, baffles, dispersion holes, any structure for directing the flow of water within interior volume 405, or any combination thereof in order to direct water in contact with heaters 411. For example, interior volume may include separation walls, baffles, and dispersion holes similar to booster tank 100.

The booster tank 400 temperature may be maintained by thermostat 424. Thermostat 424 is located as close to a point at which the rinse water enters booster tank 400 as practical.

The rinse water exits booster tank 400 at rinse water outlet fitting 415. The rinse water may flow to a rinse header from rinse water outlet fitting 415 through tubing and the rinse header may exit tub weldment 310 and proceed outside of tub 300 or travel within tub 300 (below and/or above the wash tank water level) to an anti-siphoning device and to an upper rinse arm and lower rinse arm to form a rinse water spray similar to booster tank 100.

While the rinse water flows within interior volume 405 energy transfer occurs from heated rinse water heated in booster tank 400 via conduction through the booster tank walls, for example sidewall 425*a* and rear wall 425*c* to wash water 309 within tub weldment 310.

It has been determined by the present disclosure that thicknesses of sidewall 425*a*, front wall 425*b* and rear wall 425*c* should be minimized to allow for the greatest energy transfer rate to wash water 309 possible without jeopardizing the structural integrity of the tank per the operating temperatures and pressures required. The thickness may be, such as, for example, from about 0.06 inches to 0.25 inches.

Wash pump section 500 is separate from booster tank 400 similar to wash pump sump section 13 as shown in FIG. 19. Wash pump section 500 heats water prior to distribution of the water, for example, by a wash arm, similar to wash pump sump section 13. Wash pump section 500 has a housing 525. Housing 525 has a front wall 525*a*, sidewall 525*b*, side fitting 525*c* and rear fitting 525*d*, however, housing 525 may be any shape.

Wash pump section 500 may have a drain connection (not shown) and a wash pump suction connection 545 each for passage of water therethrough. Wash pump suction connection 545 may be through side fitting 525*c*. The drain connection drains fluid out of wash pump sump section 500, such as, for example through a wash tank drain. The wash tank drain may be a ball type valve or gate valve both of which may be operated by handle or motorized. Draining may also be accomplished by a removable standpipe. Wash pump suction connection 545 is connectable to a pump 514 in a pump housing. Pump 514 may be, for example, a centrifugal pump that is 0.5 to 3.0 horsepower. Wash pump suction connection 545 may have one or more studs to connect pump 514.

Front wall 525*a* has a wash tank heater opening having a wash tank heater 511*h*. Wash tank heater 511*h* may be removably connected to front wall 525*a* to allow for installation and service. Any number or type of heating elements that heat water within wash pump section 500 may be used, for example, electrical or steam heaters. Studs for connection of wash tank heater 511*h* may surround the wash tank heater opening.

Alternately, heating elements may be connected within tub weldment 310, for example, through an opening in the wall of tub weldment 310 separate from an opening in the wall of tub weldment 310 connecting pump 514. The wash water 309 is directed across the heating elements prior to entering a suction area of the pump, for example, heating elements connected within tub weldment 310 are shrouded to direct wash water 309 across the heating elements prior to entering a suction area of the pump. Heating elements may alternatively be after discharge of the wash water from pump 514, for example, within with the wash manifolds or dispersing conduits as well as smaller elements within each individual arm.

Rear fitting 525*d* has an opening 535 that is at least partially covered by a shroud 510. Shroud 510 may be a conduit shaped as a tube, however, shroud 510 may be any shape to direct wash water 309 into contact with wash tank heater 511*h*. Shroud 510 has a sidewall 590 covering opening 535. Shroud 510 directs flow of liquid entering wash pump section 500. Shroud 510 may be lesser in length, greater in length or substantially the same length as wash tank heater 511*h*. As shown in FIG. 24, shroud 510 may have one or more holes 591 in sidewall 590. One or more holes 591 prevent trapping air underneath shroud 510. Pump 514 generates suction to move wash water 309 from tub weldment through shroud 510 and housing 525 to wash arms, for example, via tubing 516, similar to dishwashing machine 200. Shroud 510 may have holes and/or mesh type strainer which directs wash water 309 across wash tank heater 511*h* prior to the wash water 309 entering pump 514.

Wash pump section 500 is connected to tub weldment 310 so that an exterior portion 513*a* of wash pump section 500 is outside of the interior volume of tub weldment 310 and an interior portion 513*b* is within the interior volume of tub weldment 310. Advantageously, exterior portion 513*a* may have the drain connection and wash pump suction connection 545 so that all plumbing connections to water sources and pump 514 are outside of the dishwashing machine system are underneath a portion of tub weldment 510. These water connections and associated plumbing may therefore be removed from the top of the machine and consequentially frees the top of dishwashing machine for storage, such as, for example, storage of clean racks, and minimizing or eliminating added square footage of floor space to a footprint of a dishwashing machine.

Rear fitting 525*d* is shaped to connect and seal wash pump section 500 with tub weldment 310, such as, for example by welding, gasket and bolts, and the like. Rear fitting 525*d* may abut the tub weldment 310 so that the connection is substantially impervious to liquid. Wash pump section 500 may be removable from tub weldment 310 for service and replacement. For example, wash pump section 500 may be bolted to tub weldment 310 and bolts may be removed from outside or inside of tub weldment 310, so that wash pump section 500 is easily removable.

Booster tank 400 and/or wash pump section 500 may include wiring for electrical connections and installed plumbing prior to connection to a dishwashing machine. For example, heaters 405, wash tank heater 511*h*, thermostat 424, a wash tank thermostat, and/or a wash tank water level float, may be wired for electrical connection to a power source, and the wash tank drain and/or inlet water supply plumbing may be installed prior to connection of booster tank 400 to a dishwashing machine and/or wash pump section 500.

In use, pump 514 generates suction to draw wash water 309 within tub weldment 310 to flow between wash heater shroud 510 into contact with wash tank heater 511*h*. Shroud 510 also directs the water for maximum heat energy transfer. Advantageously, wash water 309 having energy added by wash tank heater 511*h* may be immediately directed to pump 514 and not allowed to disperse to the battery of wash water 309 within tub weldment 310. Another advantage of wash water 309 having energy added by wash tank heater 511*h* that is immediately directed to pump 514 includes ensuring that the hottest water in tub weldment 310 is directed to wash arms and subsequently sprayed onto dishes that are being washed in the dishwashing machine. Water temperature at the dishes being washed by a dishwasher including wash pump section 500, for example, may be about 0.5 degrees to about 5.0 degrees hotter than a pump taking suction elsewhere in tub weldment, or in a dishwashing machine that does not have wash pump section 500. This temperature difference will depend greatly upon the size of the heating elements (kW) as well as the volumetric flow rate (gallons per minute) provided by the pump in each particular system.

Wash water 309 may be directed to tank heater 511*h* via strainer holes at or near where liquid enters shroud 510. It has been found by the present disclosure that wash tank water 309 that is directed longitudinally along wash tank heater 511*h* maximizes energy transfer. A distance from wash tank heater 511*h* and shroud 510 are minimized to maximize energy transfer between liquid and wash tank heater 511*h*.

It has also been found by the present disclosure, that wash water 309 is heated by booster tank 400 within tub weldment 310 through the walls of booster tank 400. Advantageously, an increase in energy or heat through energy or heat transfer from booster tank 400, and, in particular, energy or heat transfer from sidewall 425*a*, front wall 425*b* and/or rear wall 425*c*, to wash water 309 within tub weldment 310 allows for more heat units or energy to be imparted to ware via a wash spray through wash arms that dispenses wash tank water 309 from tub weldment 310 to wares in a wash section of dishwashing machine 300.

Typical booster tanks may require heating elements for a combined total of as much as 45 kW depending on machine specifications. For example, a booster tank having a requirement of 200 gallons per hour (GPH) of water that raises an incoming temperature of 110 degrees Fahrenheit to a final rinse temperature of 180 degrees Fahrenheit will require an energy consumption of 34.2 kW/Hr. This is given by the equation: $Q=mcp\Delta T$ where: Q is the energy consumption, m is the mass flow rate, cp is the specific heat capacity of water and $\Delta T$ is the temperature rise required.

It has been determined by the present disclosure that if an amount of energy or heat units required to sanitize the ware to a predetermined level is achieved in wash water 309 and the wash spray by "stealing" or receiving via energy transfer, energy or heat from booster tank 400 that is submerged in tub weldment 310, then rinse water consumption of the final rinse spray is reduced. The rinse water consumption may be reduced to a volume just high enough to remove detergent residue from the ware.

For example, a unit such as that shown in FIGS. 22 through 24, a value as low as 60 GPH of rinse water may suffice for the same temperature rise given above (110 degrees Fahrenheit to a final rinse temperature of 180 degrees Fahrenheit) having an energy consumption in booster tank 400 of approximately 10.3 kilowatts per hour (kW/Hr). It has been determined by the present disclosure, that energy transfer from booster tank 400 to wash water 309 may raise a temperature of wash water to be sufficient to pass approximately 40% more dishes through a dishwasher without a wash tank temperature falling below allowable limits, for example, 160 degrees Fahrenheit. Advantageously, energy may be reduced, greater number of wares may be washed, water pressure may be decreased, temperature demand may be decreased to increase amount of wares washed, energy consumption may be reduced, water usage may be reduced, or any combination thereof.

Water temperature at the dishes being washed by a dishwasher including wash pump section 500, for example, may be about 0.5 degrees to about 5.0 degrees hotter than a pump taking suction elsewhere in tub weldment or in a dishwashing machine that does not have wash pump section 500. This temperature difference will depend greatly upon the size of the heating elements (kW) as well as the volumetric flow rate (gallons per minute) provided by the pump in each particular system. This effect can also be achieved by placing a heating element within a suction tube and/or within a discharge tube of the wash pump. This could also take the form of heating elements within with the wash manifolds as well as smaller elements within each individual arm. Additionally, a pump discharge tube may be routed to enter a interior volume 405 of booster tank 400 to gain energy transfer through the wall of the tubing from the relatively hot rinse water in interior volume 405. All potential flow paths must ensure the separation of the fresh rinse tank water from the "dirty" wash tank water. Advantageously, wash water 309 now enters pump 514 at a higher temperature than an average overall temperature of wash water 309.

Advantageously, it has been determined by the present disclosure that booster tank 400 provides for predetermined temperature requirements while radiating heat to wash water 309 during both normal wash cycles as well as idle times by energy transfer to wash tank water in tub weldment 310 to at least partially compensate for loss of energy of wash tank water.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A dishwashing machine comprising:

a tub having an interior that holds a first liquid;

a booster tank comprising a housing with a first portion disposed within said interior of said tub and a second portion disposed outside said interior of said tub, an inlet disposed in said second portion of said housing that receives a second liquid from a liquid source through a liquid supply plumbing that is connected to said inlet and external to the tub, and at least one heater disposed within said housing, wherein said first portion of said housing is at least partially submerged within said first liquid that is being held by said tub during operation of the dishwashing machine, whereby said first liquid is heated by said booster tank; and a pump assembly for pumping said heated first liquid from said interior of said tub to a spraying device, wherein said second liquid is in contact with and heated by said heater.

2. The dishwashing machine of claim 1, wherein said booster tank is disposed through a sidewall of said tub.

3. The dishwashing machine of claim 1, wherein said heater is removably disposed within said housing.

4. The dishwashing machine of claim 1, wherein said housing further comprises:

an outlet that dispenses said heated second liquid, wherein said outlet is in fluid communication with a device that sprays said heated second liquid into said tub.

5. A dishwashing machine comprising:

a tub having an interior holding a first liquid therein;

a wash pump assembly comprising: a pump housing; a first inlet in said pump housing; a first outlet in said pump housing; and a pump having a motor that pumps said first liquid from said tub through said pump housing via said first inlet to a device that sprays said first liquid within a dishwasher via said first outlet that is above said first liquid being held in said tub and wherein said first liquid is heated by means of a first heater which is disposed either above said first inlet, in proximity to front of said first inlet, in proximity to said first outlet, and/or in said spray device before said first liquid is pumped out of said spray device, and wherein said first heater is submerged within said first liquid during operation of the dishwashing machine, and a booster tank comprising a housing with a first portion disposed within said interior of said tub and a second portion disposed outside said interior of said tub, a second inlet disposed in said second portion of said housing that receives a second liquid from a liquid source through a liquid supply plumbing that is connected to said second inlet and external to the tub and a second heater disposed within said booster tank housing, wherein said first portion of said booster tank housing is at least partially submerged within said first liquid that is being held by said tub during operation of the dishwashing machine, whereby said first liquid is heated by said booster tank, and wherein said second liquid is in contact with and heated by said second heater.

6. The dishwashing machine of claim 5, wherein said first liquid is heated by means of said first heater which is disposed above said first inlet or in proximity to front of said first inlet, and wherein said first heater is disposed in a conduit directly connected to said pump housing.

7. The dishwashing machine of claim 5, wherein said first liquid is heated by means of said first heater which is disposed above said first inlet or in proximity to front of said first inlet, wherein said first heater is connected within said tub through an opening in a wall of said tub separate from an opening in a wall in said tub that said first liquid is pumped through to said pump housing, and wherein said heater is shrouded to direct said first liquid across said heater to said pump housing.

8. The dishwashing machine of claim 5, wherein said first liquid is heated by means of said first heater which is disposed in proximity to said first outlet, and wherein said heater is disposed in discharge tubing connected to said pump housing.

* * * * *